US007317366B1

(12) United States Patent
Duer

(10) Patent No.: US 7,317,366 B1
(45) Date of Patent: Jan. 8, 2008

(54) VHF SIGNAL REMITTER

(76) Inventor: David H. Duer, 3317 S. Ash Pl., Broken Arrow, OK (US) 74012

( * ) Notice: Subject to any disclaimer, the term of this patent is extended or adjusted under 35 U.S.C. 154(b) by 952 days.

(21) Appl. No.: 10/615,212

(22) Filed: Jul. 8, 2003

(51) Int. Cl.
*H01P 1/00* (2006.01)

(52) U.S. Cl. ..... 333/245; 333/136; 333/24 R

(58) Field of Classification Search ..... 333/24 R, 333/127, 136, 245
See application file for complete search history.

(56) References Cited

U.S. PATENT DOCUMENTS 5,793,336 A * 8/1998 Shoemaker et al. ..... 343/795
5,929,818 A * 7/1999 Snyder ..... 343/725
5,933,123 A * 8/1999 Kaul ..... 343/879
5,999,137 A * 12/1999 Crosby ..... 343/725
6,281,852 B1 * 8/2001 Amarillas ..... 343/725
6,295,037 B1 9/2001 Williams ..... 343/906
6,509,815 B1 * 1/2003 Stolle ..... 333/245

* cited by examiner

*Primary Examiner*—Robert Pascal
*Assistant Examiner*—Kimberly E Glenn
(74) *Attorney, Agent, or Firm*—Frank J. Catalano

(57) ABSTRACT

A VHF signal remitter is usable with a satellite system having a coaxial cable connected between the satellite dish and the satellite signal receiver to feed the VHF signal detected by the outer shield of the cable to the antenna input terminal of the receiver. A first coaxial cable is adapted for connection between the output end of the satellite cable and the satellite input terminal of the receiver. A second coaxial cable adapted at one end for connection to the receiver antenna input terminal has an exposed center conductor spliced to the outer shield of the first cable. A coil spring girds the splice and a clamp rigidly secures the first and second cables in juxtaposition with each other proximate the splice. Heat shrunk extruded plastic covers the coil spring and the clamp to protect the splice.

7 Claims, 2 Drawing Sheets

VHF SIGNAL REMITTER

BACKGROUND OF THE INVENTION

This invention relates generally to VHF signal transmission and more particularly concerns a remitter for passing VHF signals present in the outer shield of a satellite dish system coaxial cable to the antenna input of a television tuner.

At present, only a few major cities include VHF network programming in their satellite dish service package. Consequently, satellite subscribers either restrict their viewing options to satellite stations or rely on indoor or outdoor antenna systems to bring a clear VHF signal to their television tuner. Indoor antenna systems vary considerably in picture quality. Outdoor antenna systems are generally more consistent in providing quality pictures. Either can be very expensive and an eyesore.

U.S. Pat. No. 6,295,037 to Williams teaches connection of a central conductor of a TV cable to the metal shield of an input cable to provide an acceptable antenna for use in emergency situations when the cable signal is lost. In an emergency situation, an insert is connected in series between the TV connector central conductor and the incoming cable shield. To return to cable viewing, the insert must be removed and the cable reconnected. This connection and disconnection process can be avoided by inclusion of a switch in the insert, but viewing is still an either/or option depending on the position of the switch.

It is, therefore, an object of this invention to provide a VHF signal remitter which utilizes a satellite dish coaxial cable shield as an antenna. Another object of this invention is to provide a VHF signal remitter which converts a satellite dish coaxial cable shield into a VHF antenna without interruption of satellite service. A further object of this invention is to provide a VHF signal remitter which firmly connects a satellite dish coaxial cable shield to the central conductor of an antenna input connector of a satellite receiver. It is also an object of this invention to provide a VHF signal remitter which permits a high quality picture to be achieved using a satellite dish cable as an antenna. And it is an object of this invention to provide a VHF signal remitter which requires no internal switching when changing between VHF and satellite dish signals.

SUMMARY OF THE INVENTION

In accordance with the invention, a VHF signal remitter is provided for use with a satellite system. The satellite system has a coaxial cable with an input end connected to the satellite dish and an output end connected to the satellite input terminal of the satellite signal receiver. The remitter feeds any VHF signal present in the outer shield of the satellite system cable to the antenna input terminal of the satellite signal receiver. The remitter has a first coaxial cable adapted at its ends for connection between the output end of the satellite cable and the satellite input terminal of the receiver. A second coaxial cable is adapted at one end for connection to the receiver antenna input terminal and has a center conductor with an exposed portion extending from its other end which is spliced to the outer shield of the first cable. In a preferred embodiment, a coil spring girds the spliced portions of the first cable and the center conductor of the second cable to assure firm electrical contact of the splice. A clamp rigidly secures the first and second cables in juxtaposition with each other proximate the spliced portions of the first cable and the center conductor of the second cable to further assure the integrity of the splice. Preferably, the clamp is an aluminum ferrule crimped to grip the first and second cables. A covering, preferably heat shrunk extruded plastic, protects the coil spring and the clamp.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
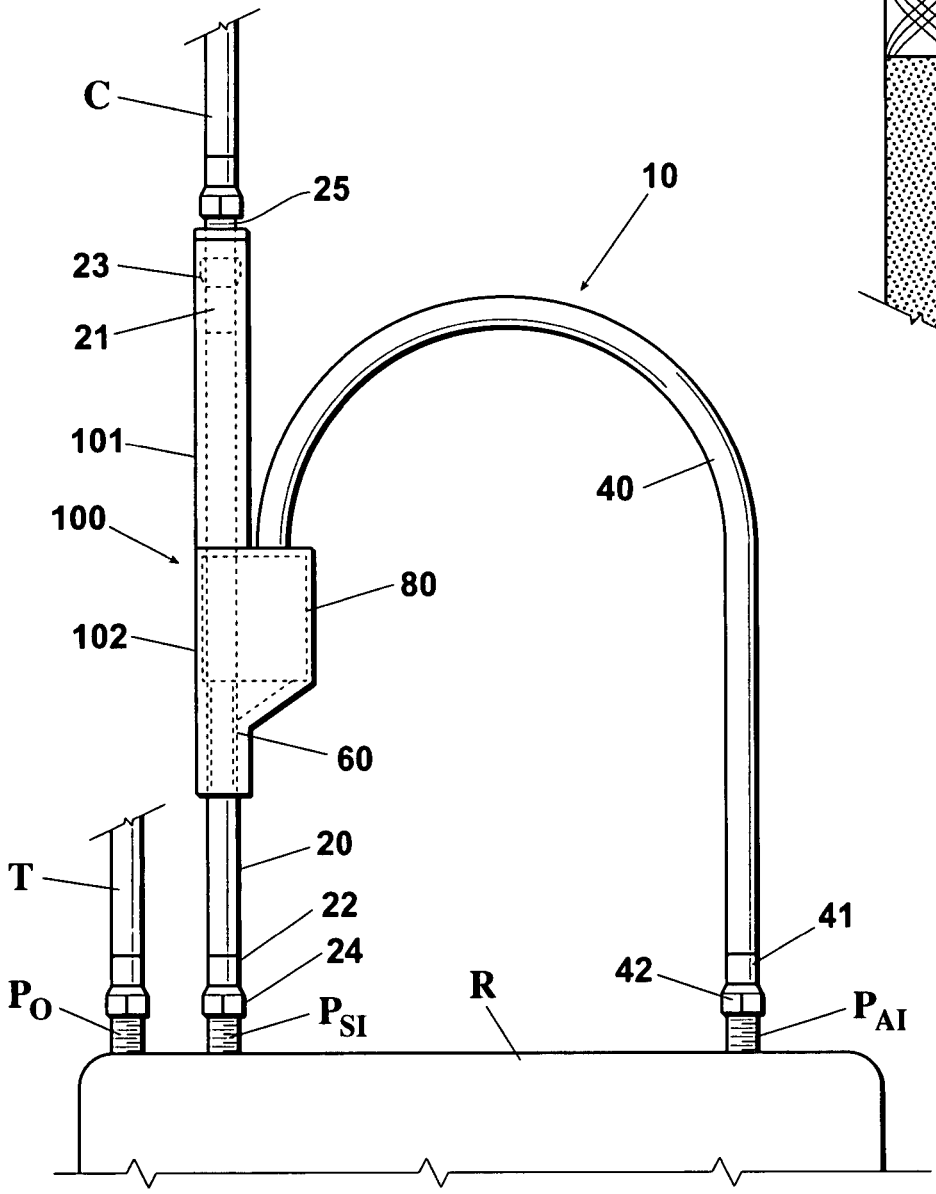
FIG. 1 is an elevation view illustrating a preferred embodiment of the VHF signal remitter connected in a satellite system.

Looking at FIG. 1, a VHF signal remitter 10 is shown. When attached to a personal satellite receiver system R, the remitter 10 transmits any VHF signal that may be resonating on the outer shielding of that system back to the television tuner T by means of the satellite receiver antenna input port $P_{AI}$. The VHF signal remitter 10 has an extension 20, a bridge 40, a splice 60, a clamp 80 and a protective cover 100. The extension 20 is joined to the bridge 40 by the splice 60 and held secure by the clamp 80. The protective cover 100 is applied over the splice 60 and clamp 80.

The extension 20 is a piece of coaxial cable which allows any subscription signal received by the personal satellite system dish to pass undisturbed to the system receiver R. The ends 21 and 22 of the cable are terminated with F-type female connectors 23 and 24 respectively. An F type barrel connector 25 is placed on one female connector 23 of the extension 20. The existing cable C delivering the satellite signal is connected via the barrel connector 25 to the female connector 23 and the other female connector 24 is connected to the receiver's satellite input port $P_{SI}$. The extension 20 is preferably approximately 8 inches in length.

Figure 2:
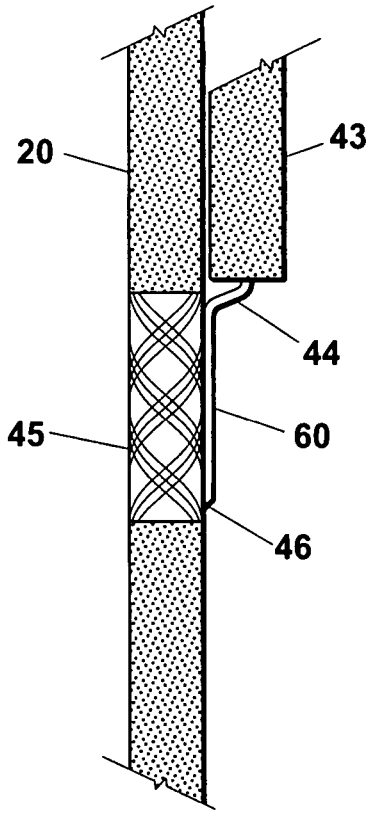
FIG. 2 is an exploded elevation view illustrating the splice of the remitter of FIG. 1.
Figure 5:
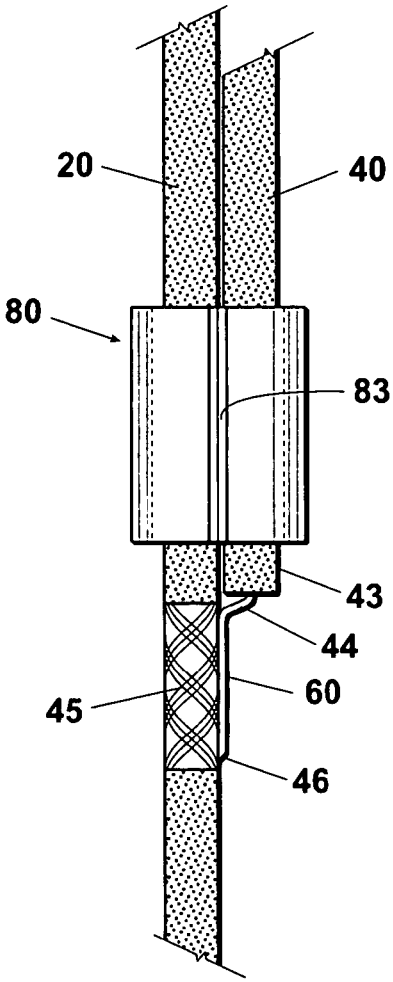
FIG. 5 is an exploded elevation view of the clamp of FIGS. 3 and 4 securing the cables of the remitter proximate the splice.
Figure 6:
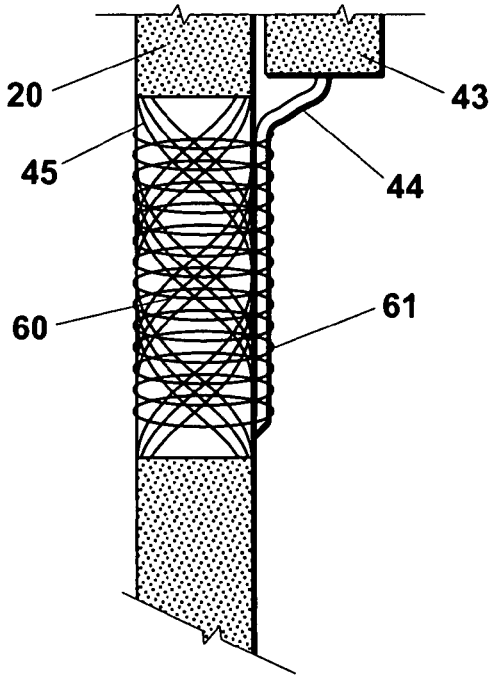
FIG. 6 is an exploded elevation view illustrating use of a spring to secure the splice of FIG. 2.

The bridge 40 is also a piece of coaxial cable having one end 41 terminated by a female F-type connector 42 and another end 43 with an exposed center conductor 44, best seen in FIGS. 2, 5 and 6. The female connector 42 is connected to the receiver's antenna input port $P_{AI}$ and the exposed center conductor 44 is spliced to the shield of the extension 20, also best seen in FIGS. 2, 5 and 6. Any VHF signal that may be resonating on the shield of the personal satellite system will be remitted to the television tuner T by means of the satellite receiver's output port $P_O$. The bridge 40 is preferably approximately 24 inches in length.

The splice 60 allows the center conductor 44 of the bridge 40 to contact the braided shield 45 of the extension 20, as is best seen in FIG. 2. Approximately 1.25 inches of all sheath, shield and insulator are stripped from the end 43 of the bridge 40, leaving only the center conductor 44 exposed and intact. As best seen in FIGS. 2 and 5, the end of the center conductor 44 is cut at an acute angle to provide a sharp tip or stinger 46 for insertion into the extension 20 between the outer sheath (not shown) and the shield 45. Preferably, the center conductor 44 of the bridge 40 is inserted between the sheath (not shown) and the braided shield 45 of the extension 20 at approximately 3 inches from the end of the extension 20. Looking at FIG. 6, a wire spring 61 holds the exposed conductor 44 in place against the shield 45. Alternatively, the sheath can be stripped from the shield 45 and the center conductor 44 positioned axially along the stripped portion of the shield 45 before the spring 61 is slid over the splice 60.

Figure 3:
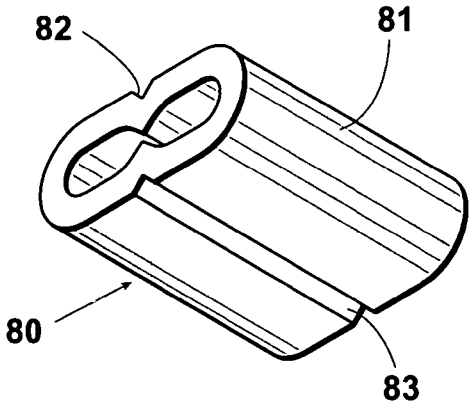
FIG. 3 is a perspective view illustrating a clamp for use with the splice of FIG. 2.
Figure 4:
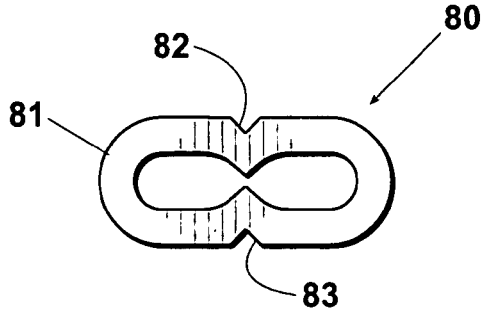
FIG. 4 is a cross-sectional view of the clamp of FIG. 3.

The clamp 80 is shown in greater detail in FIGS. 3-5. The clamp 80 is placed directly adjacent to the splice 60 and holds the bridge 40 and the extension 20 rigidly in relation to each other and assists the splice 60 to remain intact. The preferred clamp 80 is an aluminum ferrule 81. The ferrule 81 is slipped over the extension 20 and the bridge 40 and crimped by compression applied substantially uniformly at the valleys 82 and 83 on opposite sides of the ferrule 81 to grasp the bridge 40 and the extension 20 and hold them secure in relation to each other. A ferrule 1¼ inches long with ⅛ inch thick walls and ¼ inch holes is suitable for this purpose.

The protective covering 100, seen in FIG. 1, consists of extruded plastic placed over the splice 60 and clamp 80 and heated until it shrinks. The covering 100 adds further rigidity and integrity as well as aesthetic value to the remitter 10. Preferably, one piece of heat shrink 101 is placed over the male connector 23 of the extension 20 and extends from the center of the splice 60 to approximately 0.25 inches past the end of the F type barrel connector 25 and another piece of heat shrink 102 approximately 3 inches long is placed over the female connector 24 of the extension 20. This piece is slid toward the center of the extension 20 until equal lengths of heat shrink extend beyond the aluminum ferrule 81 and the outward end of the spring 61.

The combination of the spring 60, clamp 80 and covering 100 all contribute to the overall integrity of the remitter 10 and help to assure its consistent high-fidelity performance.

Thus, it is apparent that there has been provided, in accordance with the invention, a VHF signal remitter that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with a satellite system having a coaxial cable with an output end connected to a satellite input terminal of a satellite signal receiver, a remitter for feeding a VHF signal detected by an outer shield of the satellite system cable to an antenna input terminal of the satellite signal receiver comprising a first coaxial cable adapted at ends thereof for connection between the output end of the satellite cable and the satellite input terminal of the receiver and a second coaxial cable adapted at one end thereof for connection to the receiver antenna input terminal and having a center conductor with an exposed portion extending from another end thereof spliced to an outer shield of said first cable.

2. A remitter according to claim 1 further comprising a coil spring girding spliced portions of said first cable and said center conductor of said second cable.

3. A remitter according to claim 1 further comprising a clamp rigidly securing said first and second cables in juxtaposition with each other proximate spliced portions of said first cable and said center conductor of said second cable.

4. A remitter according to claim 3, said clamp comprising an aluminum ferrule compressed to grip said first and second cables.

5. A remitter according to claim 1 further comprising a coil spring girding spliced portions of said first cable and said center conductor of said second cable and a clamp rigidly securing said first and second cables in juxtaposition with each other proximate spliced portions of said first cable and said center conductor of said second cable.

6. A remitter according to claim 5 further comprising a protective covering over said coil spring and said clamp.

7. A remitter according to claim 6, said protective covering comprising heat shrunk extruded plastic.

* * * * *